US008652275B2

(12) United States Patent
Leuschner et al.

(10) Patent No.: US 8,652,275 B2
(45) Date of Patent: Feb. 18, 2014

(54) PROCESS FOR MELT DIP COATING A STRIP OF HIGH-TENSILE STEEL

(75) Inventors: Ronny Leuschner, Dortmund (DE); Manfred Meurer, Rheinberg (DE); Wilhelm Warnecke, Hamminkeln (DE); Sabine Zeizinger, Mülheim (DE); Gernot Nothacker, Dortmund (DE); Michael Ullmann, Bochum (DE); Norbert Schaffrath, Hamm (DE)

(73) Assignee: ThyssenKrupp Steel AG, Duisburg (DE)

( * ) Notice: Subject to any disclaimer, the term of this patent is extended or adjusted under 35 U.S.C. 154(b) by 676 days.

(21) Appl. No.: 11/721,138

(22) PCT Filed: Dec. 2, 2005

(86) PCT No.: PCT/EP2005/012942

§ 371 (c)(1), (2), (4) Date: Jul. 10, 2008

(87) PCT Pub. No.: WO2006/061151

PCT Pub. Date: Jun. 15, 2006

(65) Prior Publication Data

US 2008/0308191 A1 Dec. 18, 2008

(30) Foreign Application Priority Data

Dec. 9, 2004 (DE) ..... 10 2004 059 566

(51) Int. Cl.
*C23C 2/28* (2006.01)

(52) U.S. Cl.
USPC ..... 148/533; 148/277; 148/287; 148/537

(58) Field of Classification Search
USPC ..... 148/529–533, 537, 633, 634, 277, 287
See application file for complete search history.

(56) References Cited

U.S. PATENT DOCUMENTS 3,925,579 A 12/1975 Flinchum et al.
5,023,113 A 6/1991 Boston et al.

(Continued)

FOREIGN PATENT DOCUMENTS

DE 68912243 T 6/1994
DE 69507977 T 7/1999

(Continued)

OTHER PUBLICATIONS

English language machine translation of JP08-246121, generated May 2, 2011.*

(Continued)

*Primary Examiner* — Brian Walck
(74) *Attorney, Agent, or Firm* — The Webb Law Firm

(57) ABSTRACT

A process for melt dip coating a strip of high-tensile steel with alloy constituents including zinc and/or aluminum includes the following steps. The strip is heated in a continuous furnace initially in a reductive atmosphere to a temperature of approximately 650° C., at which the alloy constituents diffuse to the surface in small amounts. The surface, consisting predominantly of pure iron, is converted into an iron oxide layer by a short heat treatment at a temperature of up to 750° C. in a reaction chamber which is integrated in a continuous furnace and has an oxidizing atmosphere. In a subsequent annealing treatment at a higher temperature in a reductive atmosphere, this iron oxide layer prevents the alloy constituents from diffusing to the surface. In the reductive atmosphere, the iron oxide layer is converted into a pure iron layer to which the zinc and/or aluminum are applied in the molten bath with optimum adhesion.

18 Claims, 1 Drawing Sheet

(56) References Cited

U.S. PATENT DOCUMENTS

| | | | |
|---|---|---|---|
| 5,447,754 | A | 9/1995 | Jasper |
| 5,591,531 | A | 1/1997 | Jasper et al. |
| 2003/0047255 | A1 | 3/2003 | Delaunay et al. |
| 2004/0177903 | A1 | 9/2004 | Francois |

FOREIGN PATENT DOCUMENTS

| | | |
|---|---|---|
| EP | 0 356 783 | 3/1990 |
| EP | 1 285 972 | 2/2003 |
| GB | 1 231 478 | 5/1971 |
| JP | 2285057 | 11/1990 |
| JP | 8246121 | 9/1996 |

OTHER PUBLICATIONS

Office Action for co-pending U.S. Appl. No. 12/297,112, notification date: May 11, 2011, 12 pages.
English language translation of JPH08-246121 dated Sep. 24, 1996, 20 pages.
Response to Office Action for co-pending U.S. Appl. No. 12/297,112 dated Nov. 11, 2011, 9 pages.

* cited by examiner

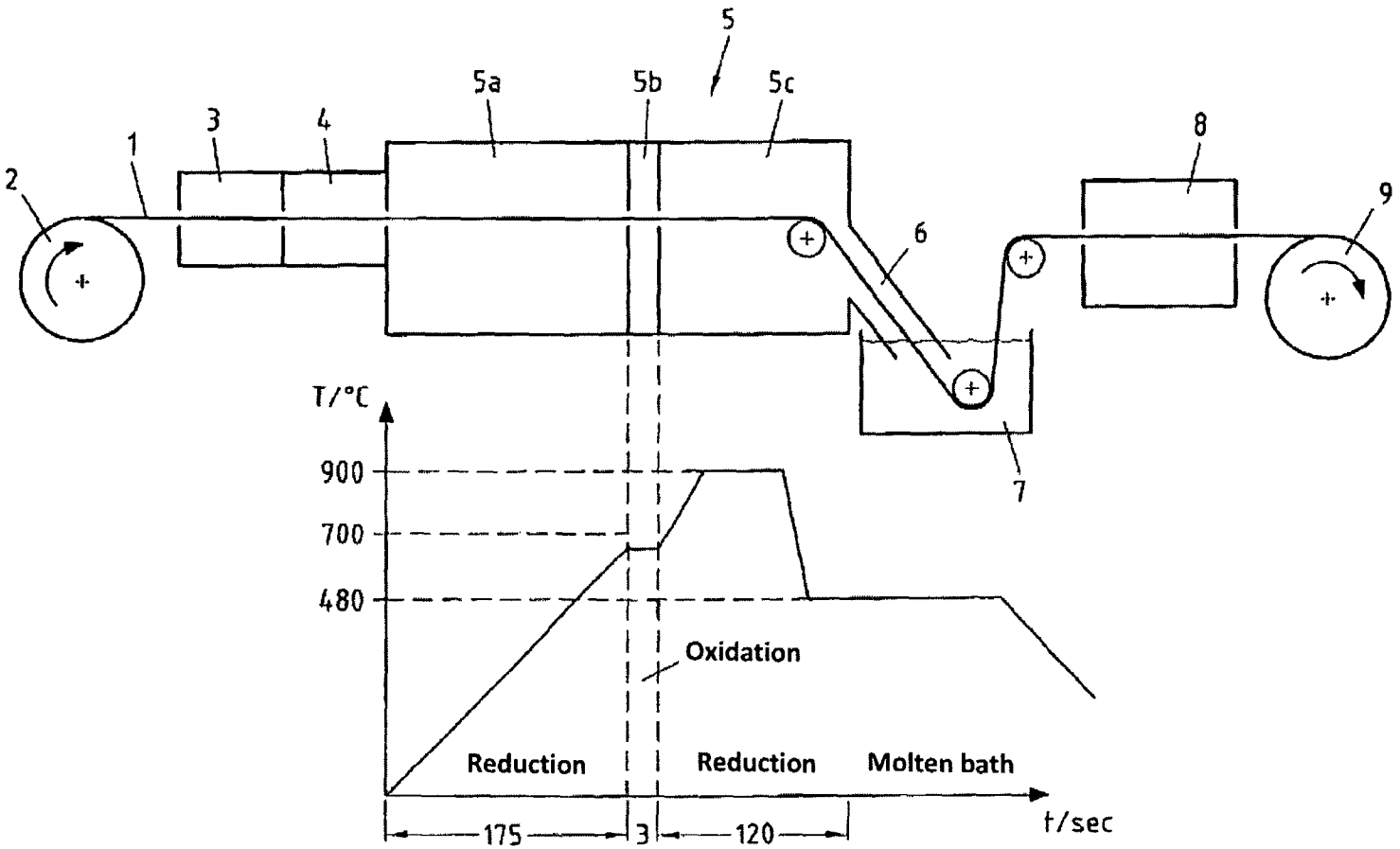
1
2
3
4
5
5a
5b
5c
6
7
8
9
T/°C
900
700
480
Oxidation
Reduction
Reduction
Molten bath
t/sec
175
3
120

PROCESS FOR MELT DIP COATING A STRIP OF HIGH-TENSILE STEEL

CROSS-REFERENCE TO RELATED APPLICATION

This application is a National Phase of International Application No. PCT/EP2005/012942 filed Dec. 2, 2005, which claims benefit of priority to German Application No. DE 10 2004 059566.6 filed Dec. 9, 2004, which is owned by the assignee of the instant application and the disclosure of which is incorporated herein by reference in its entirety.

BACKGROUND OF THE INVENTION

In the construction of motor vehicle bodyworks, hot or cold-rolled, surface-refined steel sheets are used for reasons of corrosion protection. Sheets of this type are subject to numerous requirements. They have, on the one hand, to be readily deformable and, on the other hand, to have high strength. The high strength is achieved by the addition to the iron of specific alloy constituents such as Mn, Si, Al and Cr. In order to optimize the property profile of steels of this type, it is conventional to anneal the sheets immediately prior to the coating with zinc and/or aluminum in the molten bath. Whereas the melt dip coating of steel strips containing merely low contents of the aforementioned alloy constituents is unproblematic, the melt dip coating of steel sheet having higher alloy contents presents difficulties. On the surface of the steel sheet, there result defects in the adhesion of the coating, and uncoated points even form.

In the prior art, there have been a large number of attempts to avoid these difficulties. However, there does not yet appear to have been an optimum solution to the problem.

In a known process for melt dip coating a steel strip with zinc, the strip to be coated passes through a directly heated preheater (direct fired furnace—DFF). In the gas burners used, changing the gas/air mixture can result in an increase in the oxidation potential in the atmosphere surrounding the strip. The increased oxygen potential leads to oxidation of the iron on the surface of the strip. The iron oxide layer thus formed is reduced in a subsequent furnace stretch. Purposeful adjustment of the thickness of the oxide layer at the surface of the strip is very difficult. It is thinner at high strip speed than it is at low strip speed. A clearly defined composition of the surface of the strip therefore cannot be produced in the reductive atmosphere. Again, this can lead to problems of adhesion of the coating to the surface of the strip.

In contrast to the above-described known system, modern melt dip coating lines comprising an RTF (radiant tube furnace) preheater do not use gas-heated burners. The iron therefore cannot be pre-oxidized by changing the gas/air mixture. Instead, in these systems, the complete annealing treatment of the strip is carried out in an inert gas atmosphere. However, during such annealing treatment of a steel strip comprising relatively high alloy constituents, these alloy constituents can diffuse to the surface of the strip, where they form non-reducible oxides. These oxides prevent optimum coating with zinc and/or aluminum in the molten bath.

The patent literature discloses various processes for melt dip coating a steel strip with various coating materials.

DE 689 12 243 T2 discloses a process for continuous hot dip coating a steel strip with aluminum, wherein the strip is heated in a continuous furnace. In a first zone, surface impurities are removed. For this purpose, the furnace atmosphere has a very high temperature. However, as the strip passes through this zone at high speed, it is heated merely to approximately half the atmospheric temperature. In the subsequent second zone, which is under inert gas, the strip is heated to the temperature of the coating material, aluminum.

DE 695 07 977 T2 discloses a two-stage process for hot dip coating a steel alloy strip containing chromium, wherein the strip is annealed in a first stage to obtain iron enrichment at the surface of the strip. Subsequently, the strip is heated in a non-oxidizing atmosphere to the temperature of the coating metal.

It is known from JP 02285057 A to hot dip galvanize a steel strip in a multiple-stage process. For this purpose, the previously cleansed strip is treated in a non-oxidizing atmosphere at a temperature of approximately 820° C. The strip is then treated at approximately 400° C. to 700° C. in a mildly oxidizing atmosphere before it is reduced at its surface in a reductive atmosphere. Subsequently, the strip, cooled to approximately 420° C. to 500° C., is hot dip galvanized in the conventional manner.

SUMMARY OF THE INVENTION

The object of the invention is to develop a process for melt dip coating a strip of high-tensile steel with zinc and/or aluminum, wherein a steel strip having an optimally refined surface is produced in an RTF system.

This object is achieved by the following process steps:

a) the strip is heated in a reductive atmosphere having an $H_2$ content of at least 2% to 8% to a temperature of from 650° C. to 750° C., at which the alloy constituents have not yet diffused to the surface or have done so merely in small amounts;

b) the surface, consisting predominantly of pure iron, is converted into an iron oxide layer by heat treatment, lasting from 1 to 10 sec, of the strip at a temperature of from 650° C. to 750° C. in a reaction chamber which is integrated in a continuous furnace and has an oxidizing atmosphere having an $O_2$ content of from 0.01% to 1%;

c) the strip is then annealed in a reductive atmosphere having an $H_2$ content of from 2% to 8% by further heating up to at most 900° C. and then cooled down to the temperature of the molten bath, the iron oxide layer being reduced to pure iron at least at its surface.

In the process according to the invention, the first step prevents basic alloy constituents from diffusing to the surface of the strip during the heating process. Ideally, diffusion of alloy constituents to the surface of the strip could be prevented completely, although in practice this is hardly possible. The important thing is that the diffusion of alloy constituents to the surface is suppressed to the extent that there can be formed in the following step an effective iron oxide layer preventing further alloy constituents from diffusing to the surface at the increased annealing temperature. The annealing treatment in the reductive atmosphere can thus yield a pure iron layer which is highly suitable for an extensive, tightly adhering zinc and/or aluminum coating.

The result is optimal if the iron oxide layer produced in the oxidizing atmosphere is reduced completely to pure iron, because in this case the deformation and strength properties of the coating are also optimized.

According to one embodiment of the invention, in the treatment of the strip on the stretch having the oxidizing atmosphere the thickness of the oxide layer formed is measured and adjusted, depending on this thickness and the treatment time, which is dependent on the throughput rate of the strip, the $O_2$ content, in such a way that the oxide layer can then be completely reduced. The change in the throughput rate of the strip resulting, for example, from disturbances may thus be allowed for without disadvantage for the quality of the surface of the melt dip coated strip.

Good results in the carrying-out of the process were achieved when an oxide layer having a thickness of at most 300 nanometers is produced. Good results were also achieved when the heating, preceding the oxidation, of the strip to 650° C. to 750° C. lasts at most 250 sec. The heat treatment, following the oxidation, with subsequent cooling of the strip should last longer than 50 sec.

As alloy constituents, the high-tensile steel should contain at least a selection of the following constituents: Mn>0.5%, Al>0.2%, Si>0.1%, Cr>0.3%. Further constituents such as, for example, Mo, Ni, V, Ti, Nb and P can be added.

A basic feature of the invention is that the heat treatment of the strip in the reductive atmosphere lasts longer by a multiple, during both the heating process and the subsequent annealing, compared to the heat treatment in the oxidizing atmosphere. As a result, the volume of the oxidizing atmosphere is very small compared to the remaining volume of the reductive atmosphere. This has the advantage of allowing rapid response to changes in the treatment process, in particular in the throughput rate and the formation of the oxidation layer. In this sense, the heat treatment of the strip in the reductive atmosphere is carried out in a continuous furnace with an integrated chamber having the oxidizing atmosphere, the volume of the chamber being smaller by a multiple than the remaining volume of the continuous furnace.

The process according to the invention is particularly suitable for hot dip galvanizing. However, the molten bath can also consist of zinc/aluminum or aluminum comprising silicon additives. Regardless of whether the bath consists of zinc or aluminum in isolation or in combination, the overall proportion of the melt formed thereby should be at least 85%. Examples of characteristic coatings known for this purpose include:

Z: 99% Zn

ZA: 95% Zn+5% Al

AZ: 55% Al+43.4% Zn+1.6% Si

AS: 89 to 92% Al+8 to 11% Si

In the case of a zinc coating (Z), said coating can be converted into a zinc/iron layer capable of deformation (galvannealed coat) by heat treatment (diffusion annealing).

BRIEF DESCRIPTION OF THE FIGURES

The invention will be described hereinafter with reference to a diagram schematically showing a hot dip galvanizing system comprising a continuous furnace, the temperature of the continuous furnace being plotted over the throughput time.

DETAILED DESCRIPTION OF THE FIGURES

A hot-rolled or cold-rolled strip 1 of high tensile steel having contents of Mn, Al, Si and Cr or some of these alloy constituents, although optionally also comprising further alloy constituents, in particular TRIP steel, is drawn off from a coil 2 and guided through an etchant 3 and/or another system 4 for surface cleansing. The cleansed strip 1 then passes into a continuous furnace 5. From the continuous furnace 5, the strip 1 passes via an atmospherically sealed sluice 6 into a molten bath 7 containing zinc. From the molten bath 7, the strip 1 passes via a cooling stretch 8 or a means for heat treatment to a winding station 9 in the form of a coil. In contrast to the illustration in the diagram, the strip 1 actually passes through the continuous furnace 5 not in a straight line but rather in a meandering manner so as to allow sufficiently long treatment times to be achieved with a practicable length of the continuous furnace 5.

The continuous furnace 5 is divided into three zones 5*a*, 5*b*, 5*c*. The central zone 5*b* forms a reaction chamber and is atmospherically sealed from the first and final zone 5*a*, 5*c*. Their length is merely approximately 1/100 of the overall length of the continuous furnace 5. For the sake of clarity, the drawing is therefore not to scale. In accordance with the differing lengths of the zones, the treatment times of the strip 1 passing through the individual zones 5*a*, 5*b*, 5*c* also differ.

The first zone 5*a* has a reductive atmosphere. A typical composition of this atmosphere consists of from 2% to 8% $H_2$, the remainder being $N_2$. In this zone 5*a* of the continuous furnace 5, the strip 1 is heated to 650 to 750° C. At this temperature, the aforementioned alloy constituents diffuse to the surface of the strip 1 merely in small amounts.

In the central zone 5*b*, the temperature of the first zone 5*a* is substantially merely maintained. However, its atmosphere contains oxygen. The $O_2$ content is between 0.01% and 1%. The $O_2$ content is adjustable and depends on how long the treatment time is. If the treatment time is short, the $O_2$ content is high, whereas it is low in a long treatment time. During this treatment, an iron oxide layer is formed at the surface of the strip. The thickness of this iron oxide layer can be measured by optical means. The $O_2$ content of the atmosphere is adjusted depending on the measured thickness and the throughput rate. As the central zone 5*b* is very short compared to the overall length of the furnace, the volume of the chamber is correspondingly small. The reaction time for a change in the composition of the atmosphere is therefore short.

In the subsequent final zone 5*c*, further heating is carried out to approx. 900° C., at which the strip 1 is annealed. This heat treatment is carried out in a reductive atmosphere having an $H_2$ content of from 2% to 8%, the remainder being $N_2$. During this annealing treatment, the iron oxide layer prevents alloy constituents from diffusing to the surface of the strip. As the annealing treatment is carried out in a reductive atmosphere, the iron oxide layer is converted into a pure iron layer. The strip 1 is further cooled on its further path toward the molten bath 7, so on leaving the continuous furnace 5 it has approximately the temperature of the molten bath 7 of approximately 480° C. As the strip 1, after leaving the continuous furnace 5, consists at its surface of pure iron, it provides the zinc of the molten bath 7 with an optimum base for adhesively secure connection.

The invention claimed is:

1. A process for melt coating a strip of steel having one or more alloy constituents including at least one of Mn, Al, Si and Cr, in a molten bath of in total at least 85% zinc, aluminum, or both in a cycle involving the following process steps:

a) heating the strip in a reductive atmosphere having an $H_2$ content of 2% to 8% to a temperature of from 650° C. to 750° C., wherein the heated strip has a diffusion suppressed surface at which the alloy constituents have not yet diffused to a surface of the strip or have done so merely in small amounts such that an iron oxide layer can be formed on the same diffusion suppressed surface in the following step;

b) converting the diffusion suppressed surface, consisting predominantly of pure iron, into an iron oxide layer by heat treatment, for a treatment time lasting from 1 to 10 sec, of the strip at a temperature of from 650° C. to 750° C. in a reaction chamber which is integrated in a continuous furnace and has an oxidizing atmosphere having an $O_2$ content of from 0.01% to 1%; and c) annealing the strip in a reductive atmosphere having an $H_2$ content of from 2% to 8% by further heating the strip up to at most 900° C. and then cooling the strip down to a temperature of the molten bath, the iron oxide layer being reduced to pure iron at least at its surface.

2. The process of claim 1, wherein the iron oxide layer produced is reduced completely to pure iron.

3. The process of claim 2, wherein during converting the surface in the oxidizing atmosphere, a thickness of the oxide layer formed is measured and adjusted, and depending on this thickness and the treatment time, which is dependent on a throughput rate of the strip, the $O_2$ content is adjusted in such a way that the oxide layer is then completely reduced during step c).

4. The process of claim 3, wherein an oxide layer having a thickness of at most 300 nm is produced.

5. The process of claim 1, wherein the heating, preceding the oxidation, of the strip to 650° C. to 750° C. lasts at most 250 sec.

6. The process of claim 1, wherein further heating the strip, following the oxidation, with subsequent cooling of the strip lasts longer than 50 sec.

7. The process of claim 1, wherein the steel contains at least one of the following alloy constituents: Mn>0.5%, Al>0.2%, Si>0.1%, and Cr>0.3%.

8. The process of claim 1, wherein the heat treatment of the strip in the reductive atmosphere is carried out in a continuous furnace with an integrated chamber having the oxidizing atmosphere, the volume of the chamber being smaller by a multiple than the remaining volume of the continuous furnace.

9. The process of claim 1, wherein the strip is heat treated after coating in the molten bath.

10. A process for coating a strip of steel having one or more alloy constituents including at least one of Mn, Al, Si and Cr, the process comprising:

a) heating the strip in a reductive atmosphere that includes an $H_2$ content of 2% to 8% to a temperature of from 650° C. to 750° C., wherein the heated strip has a diffusion suppressed surface at which the alloy constituents have not yet diffused to a surface of the strip or have done so merely in small amounts such that an iron oxide layer can be formed on the same diffusion suppressed surface in the following step;

b) converting the diffusion suppressed surface, consisting predominantly of pure iron, into an iron oxide layer by heat treatment, for a treatment time lasting from 1 to 10 sec, of the strip at a temperature of from 650° C. to 750° C. in an oxidizing atmosphere having an $O_2$ content of from 0.01% to 1%;

c) then annealing the strip in a reductive atmosphere that includes an $H_2$ content of 2% to 8% by further heating the strip up to at most 900° C., the iron oxide layer being reduced to pure iron at least at its surface; and d) coating the annealed strip in a molten bath that includes at least 85% of at least one of zinc and aluminum.

11. The process of claim 10, wherein the iron oxide layer produced is reduced completely to pure iron.

12. The process of claim 11, wherein during converting the surface in the oxidizing atmosphere, a thickness of the oxide layer formed is measured and adjusted, and depending on this thickness and the treatment time, which is dependent on a throughput rate of the strip, the $O_2$ content is adjusted in such a way that the oxide layer is then completely reduced during step c).

13. The process of claim 10, wherein an oxide layer having a thickness of at most 300 nm is produced.

14. The process of claim 10, wherein the heating, preceding the oxidation, of the strip to 650° C. to 750° C. lasts at most 250 sec.

15. The process of claim 10, wherein further heating the strip, following the oxidation, with subsequent cooling of the strip lasts longer than 50 sec.

16. The process of claim 10, wherein the steel contains at least one of the following alloy constituents: Mn>0.5%, Al>0.2%, Si>0.1%, and Cr>0.3%.

17. The process of claim 10, wherein the heat treatment of the strip in the reductive atmosphere is carried out in a continuous furnace with an integrated chamber having the oxidizing atmosphere, the volume of the chamber being smaller by a multiple than the remaining volume of the continuous furnace.

18. The process of claim 10, wherein the strip is heat treated after coating in the molten bath.

* * * * *

UNITED STATES PATENT AND TRADEMARK OFFICE

CERTIFICATE OF CORRECTION

PATENT NO. : 8,652,275 B2
APPLICATION NO. : 11/721138
DATED : February 18, 2014
INVENTOR(S) : Leuschner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1201 days.

Signed and Sealed this
Twenty-ninth Day of September, 2015

Michelle K. Lee

Michelle K. Lee
*Director of the United States Patent and Trademark Office*